US009827167B2

(12) United States Patent
Mueller

(10) Patent No.: US 9,827,167 B2
(45) Date of Patent: Nov. 28, 2017

(54) PRECISION VITAMIN AND MEDICATION ORGANIZER

(71) Applicant: Maryann Mueller, Altamont, NY (US)

(72) Inventor: Maryann Mueller, Altamont, NY (US)

( * ) Notice: Subject to any disclaimer, the term of this patent is extended or adjusted under 35 U.S.C. 154(b) by 0 days.

(21) Appl. No.: 15/435,828

(22) Filed: Feb. 17, 2017

(65) Prior Publication Data

US 2017/0239145 A1 Aug. 24, 2017

Related U.S. Application Data

(60) Provisional application No. 62/389,108, filed on Feb. 18, 2016.

(51) Int. Cl.

| | |
|---|---|
| ***B65D 83/04*** | (2006.01) |
| ***A61J 7/04*** | (2006.01) |
| ***A61J 7/00*** | (2006.01) |
| ***B65D 25/04*** | (2006.01) |
| ***B65D 43/14*** | (2006.01) |
| ***B65D 51/24*** | (2006.01) |
| ***A61J 1/03*** | (2006.01) |

(52) U.S. Cl.

CPC . *A61J 7/04* (2013.01); *A61J 1/03* (2013.01); *A61J 7/0084* (2013.01); *B65D 25/04* (2013.01); *B65D 43/14* (2013.01); *B65D 51/245* (2013.01)

(58) Field of Classification Search

CPC ... A61J 7/04; A61J 7/0084; A61J 1/03; B65D 43/14; B65D 51/245; B65D 25/04

USPC ..... 206/528, 530, 534, 534.1, 534.2, 538, 206/539, 540, 459.5, 459.1

See application file for complete search history.

(56) References Cited

U.S. PATENT DOCUMENTS

| | | | | | |
|---|---|---|---|---|---|
| 3,638,603 | A * | 2/1972 | Conover | A61J 7/04 | 116/308 |
| 3,960,713 | A * | 6/1976 | Carey | A61J 7/04 | 116/308 |
| 4,535,903 | A * | 8/1985 | Franchi | B65D 50/069 | 206/534 |
| 4,703,712 | A * | 11/1987 | Christman | H01H 15/025 | 116/321 |
| 4,793,492 | A * | 12/1988 | Halbich | A45C 11/24 | 206/538 |
| 5,216,975 | A * | 6/1993 | Bartholomew | G09F 11/23 | 116/321 |

(Continued)

*Primary Examiner* — Jacob K Ackun
*Assistant Examiner* — Jenine Pagan

(57) ABSTRACT

Disclosed herein are approaches for a precise medication, vitamin, and/or other medication substance organizer having a plurality of storage compartments that house and separate medications and vitamins by a specific time of day and a means for indicating whether a particular medication or vitamin has already been or needs to be taken. This organizer removes doubt associated with missed or duplicate drug dosages, interactions between medications and vitamins, as well as regulating daily medication and vitamin doses. Additionally, the organizer provides a location to indicate a name and a time a medication or vitamin should be ingested or otherwise taken and an indicator to show whether a medication or vitamin has already been removed from the organizer for ingestion. The medication, vitamin, and/or other medication substance organizer can also be used to prompt a user to take medications that will not fit into the organizer, such as an inhaler.

20 Claims, 2 Drawing Sheets

(56) References Cited

U.S. PATENT DOCUMENTS

| | | | | |
|---|---|---|---|---|
| 5,778,818 | A * | 7/1998 | Marshall | A61J 7/04 116/309 |
| 5,833,066 | A * | 11/1998 | Hargus | A61M 15/00 116/317 |
| 8,459,459 | B2 * | 6/2013 | Noble | A61J 7/04 206/1.5 |
| 2002/0088737 | A1 * | 7/2002 | Stepp | A61J 1/035 206/538 |
| 2006/0219595 | A1 * | 10/2006 | Peters | A61J 7/04 206/534 |
| 2008/0168940 | A1 * | 7/2008 | Duer | G09F 7/00 116/324 |
| 2009/0166243 | A1 * | 7/2009 | Cetera | A61J 1/03 206/528 |

* cited by examiner

PRECISION VITAMIN AND MEDICATION ORGANIZER

CROSS REFERENCE TO RELATED APPLICATION

The present invention claims priority to provisional U.S. patent application 62/389,108 entitled "Precision Vita-med Organizer" and filed on Feb. 18, 2016, the entire contents of which are incorporated herein by reference.

FIELD OF THE INVENTION

The present invention generally relates to medication and/or vitamin organizers and more specifically relates to medication and/or vitamin organizers having a means for indicating that a medication substance has been consumed.

BACKGROUND OF THE INVENTION

Many individuals, especially the elderly, have a tendency to forget to take their medications and other health supplements, such as vitamins. Missed medication can cause mild to severe medical issues. So too can accidentally taking a second dose of a medication when an individual cannot recall whether he or she already took the medication. To be effective, many medications and vitamins must be taken on a daily basis, sometimes even multiple times a day. Although medication and vitamin organizers exist that indicate a general segment of a day, such as morning, noon, night, or bedtime, at which a medication and/or vitamin should be taken, such fail to specify a specific time, which can cause an individual to vary a time he or she takes a medication and/or vitamin each day by several hours. There is a risk of possible drug and vitamin interactions, as well as the loss of benefits, if a medication is not ingested properly, missed, or taken at the wrong time, as well as if a medication is taken with a vitamin that affects the effectiveness of the medication. Therefore, it is imperative that the elderly, as well as many other segments of the population, easily and accurately remember to take their regular medications, daily vitamins, and any other health supplements at regular times each day.

SUMMARY OF INVENTION

Disclosed herein are approaches for a precise medication, vitamin, and/or other medication substance organizer having a plurality of storage compartments that house and separate medications and vitamins by a specific time of day and a means for indicating whether a particular medication or vitamin has already been or needs to be taken. This medication, vitamin, and/or other medication substance organizer removes doubt associated with missed or duplicate drug dosages, interactions between medications and vitamins, as well as regulating daily medication and vitamin doses. Additionally, the medication, vitamin, and/or other medication substance organizer provides a location to indicate a name and a time a medication or vitamin should be ingested or otherwise taken and an indicator to show whether a medication or vitamin has already been removed from the organizer for ingestion. The medication, vitamin, and/or other medication substance organizer can also be used to prompt a user to take medications that will not fit into the organizer, such as an inhaler.

One aspect of the present invention includes a medication substance organizer, comprising: a housing comprising a plurality of compartments adapted to receive one or more medication substances; a plurality of lids fastened to each of the plurality of compartments; a plurality of indicators disposed on each lid of the plurality of lids, each lid corresponding with an indicator disposed thereon, wherein: each indicator of the plurality of indicators is a width of the corresponding lid, each indicator of the plurality of indicators has two visual signs, a first visual sign of the two visual signs indicating a medication substance has not been taken and a second visual sign of the two visual signs indicating a medication substance has been taken, and each visual sign of the two visual signs is a half width of the corresponding lid; a plurality of sliders disposed over each of the plurality of indicators, wherein: each slider of the plurality of sliders is a half width of the corresponding lid, each slider moves along one degree of freedom from the first visual indicator to the second visual indicator, and each slider covers the first visual sign when in a first position and covers the second visual sign when in a second position; and a plurality of labels fastened to each lid of the plurality of lids, each lid corresponding with a label fastened thereon, wherein each label indicates a medication substance and a time associated with the compartment corresponding to the lid corresponding to the label.

BRIEF DESCRIPTION OF SEVERAL VIEWS OF THE DRAWINGS

These and other features of this invention will be more readily understood from the following detailed description of the various aspects of the invention taken in conjunction with the accompanying drawings in which.

Figure 1:
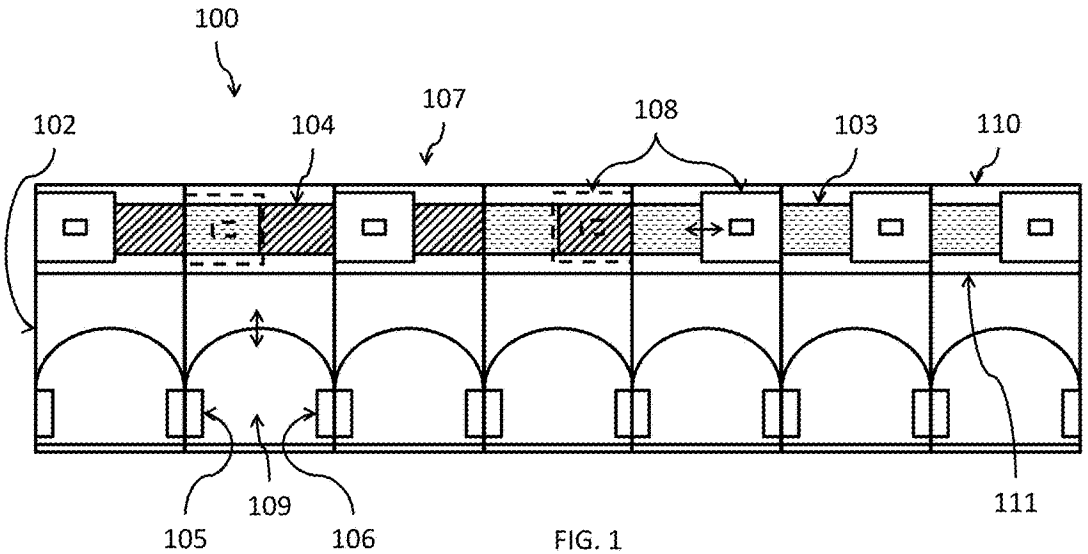
FIG. 1 illustrates a downward-facing view of a medication and/or vitamin organizer from a top with all lids dosed according to illustrative embodiments of the present invention.

The drawings are not necessarily to scale. The drawings are merely representations, not intended to portray specific parameters of the invention. The drawings are intended to depict only typical embodiments of the invention, and therefore should not be considered limiting in scope. In the drawings, like numbering represents like elements.

DETAILED DESCRIPTION OF THE INVENTION

Embodiments of the present invention relate to a medication substance (e.g., medication, vitamin, and/or pill) organizer. More specifically, the present invention provides a safer, more precise way to ensure medication and vitamins are taken on time and in the correct dosage, thereby preventing interactions between medications and vitamins and with the added benefit of not requiring a user to have to remember whether he or she has taken his or her medication or not. The organizer of embodiments of the present invention provides a user with an exact time medication substance should be taken and a means for checking off that such medication substance has been taken. Embodiments can also help a user with an efficacy of absorption of his or her daily medications and/or vitamins. Accordingly, the problems of drug and medicine interactions, double dosages, and forgotten dosages can be avoided by using the organizer of the present invention.

As used herein, the term "medication substance" includes prescription and over-the-counter drugs, vitamins and minerals, any type of pill, and any non-pill medication, including inhalers and injections.

It should further be understood that, as used herein "type of medication substance" refers to any specific medication substance, for example aspirin.

Embodiments offer an improvement on past medication and vitamin organizers, which only show a segment of a day or day of the week that medication should be taken. Embodiments of the present invention provide a more efficient way to take medications and vitamins using one or more precise time organizers depending on the needs of a user. In embodiments of the present invention, compartments of the organizer may be filled on demand based on the needs of a user, rather than merely a seven-day fill or a thirty-day fill. Accordingly, as a user goes through his or her daily medication requirements, the medication substance organizer of the present invention can show the user whether he or she has removed a medication, vitamin, or other substance from a compartment of the organizer, and, if not, prompt him or her to take the medication substance. Further, even if a medication (e.g., an inhaler) does not fit in a compartment of the organizer, a user can still use the organizer to mark off whether he or she has taken that medication yet.

Reference is made herein to the attached drawings. Like reference numerals are used throughout the drawings to depict like or similar elements. To present a brief and clear description of the present invention, preferred embodiments will be discussed. The Figures are intended for representative purposes only and should not be considered to be limiting in any respect.

Referring to FIG. 1, a downward-facing view of medication substance organizer 100 from a top with all lids 102 closed is shown according to illustrative embodiments of the present invention. In embodiments of the present invention, the organizer has a plurality of recessed areas or compartments 214 (FIG. 2, discussed below) with lids 102.

Lids 102 each have a bracketed area (e.g., at a bottom of lid 214) for sliding in card or label 109 (or another name and time indicator, such as a label or wording written with, e.g., a marker) showing a name of a medication, vitamin, pill, and/or other medication substance and an exact time of day said medication, vitamin, pill, and/or other medication substance, should be taken, as determined or chosen by the user. Card or label 109 can be inserted between left bracket 105 and right bracket 106 of lid 102. In some other embodiments, card or label 109 can be fastened to a lid 102 with any other type of fastener, including, but not limited to, a clear pouch, an adhesive, a temporary adhesive, a loop and hook material, a snap, and a magnet. Name and time information can be specified by a user. Cards or labels 109 can be moved, removed, and/or replaced depending on the needs of a user, thereby making organizer 100 highly versatile. A user may label a lid 102 that corresponds with an empty compartment 214 to act as a placeholder and to indicate a time and medication substance that is otherwise unable to be placed within compartment 214, such as an inhaler or an injection.

Each lid 102 further binary indicator 107 to show whether a medication substance corresponding to the compartment associated with that lid has been taken/consumed. In one embodiment, binary indicator 107 can be an area on lid 102 having two colors, such as green 103 and red 104. In other embodiments, binary indicator 107 can be two symbols, such as an unchecked box and a box with a check mark or an "X," two icons, such as a happy and sad face, or two words, such as "yes" and "no." For example, lid 102 can have a green area 103 located at a left half of a top of each lid 102 and a red area 104 located at a right half of the top of each lid 102. When green area 103 is exposed, it can indicate to a user that a dose of medication, vitamin, or other medication substance from the corresponding compartment has not yet been taken and should be taken when at the time indicated on card or label 109. When red area 104 is exposed, it can indicate to a user that he or she has already taken the medication, vitamin, or other medication substance from the corresponding compartment and should not take more at that time.

According to some embodiments, binary indicator 107 can include a sliding component 108, that is half the width of lid 102, and that glides over (e.g., sliding left to right and right to left) and covers one-half of binary indicator 107 (e.g., green area 103 or red area 104, but not both). In other words, when a first half of binary indicator 107 is showing, a second half of the binary indicator 107 is concealed by sliding component 108. In some embodiments, a top bracket 110 and a bottom bracket 111 located on a portion of lid 102 can hold slider 108 in place over binary indicator 107, restricting slider 108 to one degree of freedom sliding back and forth over binary indicator 107. For example, slider 108 can be held in place behind top bracket 110 and bottom bracket 111. In some embodiments, binary indicator 107 and brackets 110 and 111 can be located at a top portion of lid 102.

Figure 2:
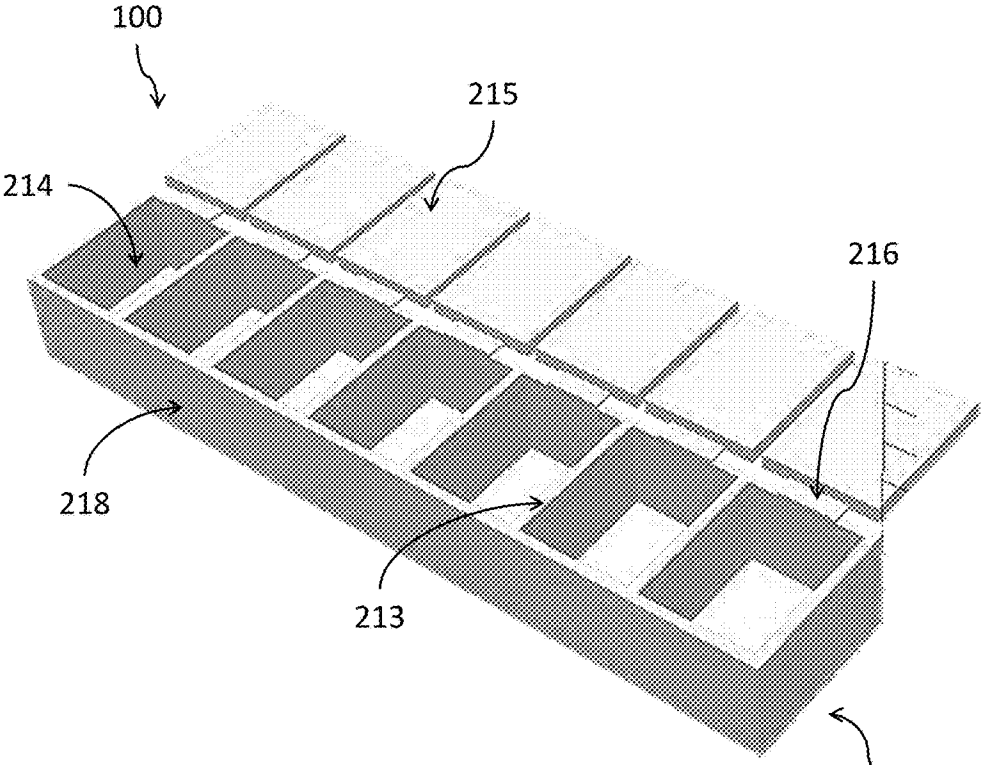
FIG. 2 illustrates an isometric view of the medication organizer of FIG. 1 with all lids open to show a set of compartments according to illustrative embodiments of the present invention.

Referring now to FIG. 2, an isometric view of organizer 100 of FIG. 1 with lids 102 open to show insides of compartments 214 is shown. It should be understood that the structure of compartments 214 can be similar to pre-existing medication organizers, and made of materials such as food-grade materials. For example, housing 217 can hold and/or be comprised of a plurality of compartments 214. In some embodiments, organizer 100 can have a number of compartments 214 corresponding to a period of time, such as seven (7) compartments for a week or thirty (30) compartments for a month. Compartments 214 can have inside dividers 213 in between each of compartments 214. Each compartment 214 can be used to separate different medications, vitamins, pills, or other medication substance by type of medication substance and time of day. In some embodiments, compartments 214 can be arranged in a grid (e.g., a four-by-seven (4×7) grid for up to four (4) different times during a day with seven (7) days in a week). In further embodiments, organizer 100 can be the shape of a rectangular prism 218. In still other embodiments, organizer 100 can have the shape of a cylinder or any other shape that facilitates easy access to medication substances in compartments 214.

Lids 102 can be opened to access compartments 214. Opening and closing lids 102 can be a repeatable process and lids 102 can have mechanism 216 for opening and closing lids 102 and for attaching lids 102 to housing 217 at each compartment 214. Such mechanism 216 can include, but is not limited to, a hinge, a flap, or a semi-deformable folded plastic crease which acts as an axis of movement. A bottom surface 215 of lids 102 can be flat, curved, or any other shape to facilitate opening and dosing lids 102.

To use organizer 100, at the beginning of each day, a user starts off with all sliders 108 of each binary indicator 107 in a start position. For example, each slider 108 may be initially positioned to hide red area 104 (i.e., "stop") and show green area 103 (i.e., "go"). Throughout the day, as the user ingests or otherwise takes his or her medication (i.e., medications, vitamins, and/or other medication substance like inhalers or injections), he or she may slide slider 108 (on lid 102 of corresponding compartment 214 from which the medication substance was taken) from a first position to a second position (e.g., from showing green area 103 to showing red area 104) to remind him or herself that he or she has already taken that medication, vitamins, and/or other medication substances. The user can repeat this action for each subsequent medication substance and/or each subsequent dosage time indicated on cards or labels 109 of organizer 100 until all lids 102 show that all medication, vitamins, or other medication substances have been taken (i.e., each indicator 107 shows red area 104) at the end of the day. The user may then reset each slider 108 (e.g., to expose green area 103) for the next morning. This process can be repeated each day until a compartment needs refilling (i.e., each compartment 214 can hold several days' worth of medication or vitamins). When a compartment is empty, it can be refilled as needed by the user. In the case organizer 100 is a grid organizer having compartments 214 corresponding to multiple days (e.g., several columns representing days by several rows representing times of day), organizer 100 need not be reset until all sliders 108 are in the "taken" position (e.g., slide to expose red area 104).

While the invention has been particularly shown and described in conjunction with exemplary embodiments, it will be appreciated that variations and modifications will occur to those skilled in the art. Therefore, it is to be understood that the appended claims are intended to cover all such modifications and changes that fall within the true spirit of the invention.

I claim:

1. A medication substance organizer, comprising:

a housing comprising a plurality of compartments adapted to receive one or more medication substances;

a plurality of lids fastened to each of the plurality of compartments;

a plurality of indicators disposed on each lid of the plurality of lids, each lid corresponding with an indicator disposed thereon, wherein:

each indicator of the plurality of indicators is a width of the corresponding lid, each indicator of the plurality of indicators has two visual signs, a first visual sign of the two visual signs indicating a medication substance has not been taken and a second visual sign of the two visual signs indicating a medication substance has been taken, and each visual sign of the two visual signs is a half width of the corresponding lid;

a plurality of sliders, a slider disposed over each of the plurality of indicators, wherein:

each slider of the plurality of sliders is a half width of the corresponding lid, each slider moves along one degree of freedom from the first visual indicator to the second visual indicator, and each slider covers the first visual sign when in a first position and covers the second visual sign when in a second position; and a plurality of labels, a label fastened to each lid of the plurality of lids, each lid corresponding with a label fastened thereon, wherein each label indicates a medication substance and a time associated with the compartment corresponding to the lid corresponding to the label.

2. The medication substance organizer of claim 1, wherein the two visual signs are selected from the group of visual signs consisting of: two colors, two icons, two symbols, and two words.

3. The medication substance organizer of claim 1, wherein the first visual sign is a green color on a first half of the indicator and the second visual sign is a red color on a second half of the indicator.

4. The medication substance organizer of claim 1, wherein each slider of the plurality of sliders is held over each indicator of the plurality of indicators by a pair of brackets.

5. The medication substance organizer of claim 1, wherein the plurality of indicators are configured, when viewed, to prompt a user of the medication substance organizer to take a medication substance.

6. The medication substance organizer of claim 1, wherein the plurality of compartments comprise a plurality of recessed areas in the housing.

7. The medication substance organizer of claim 6, wherein each recessed area of the plurality of recessed areas is adapted to receive one type of medication substance.

8. The medication substance organizer of claim 7, wherein each recessed area of the plurality of recessed areas is adapted to be filled and refilled at an interval based on a size of the one type of medication substance.

9. The medication substance organizer of claim 6, wherein at least one recessed area of the plurality of recessed areas is a placeholder for a type of medication substance that does not fit in the at least one recessed area.

10. The medication substance organizer of claim 1, wherein the plurality of compartments are arranged in a grid layout.

11. The medication substance organizer of claim 1, wherein the plurality of labels are removable from the plurality of lids.

12. The medication substance organizer of claim 11, wherein each of the plurality of lids is associated with a label of the plurality of labels and a first lid and a second lid can swap associated labels.

13. The medication substance organizer of claim 1, wherein the plurality of compartments comprise seven compartments.

14. The medication substance organizer of claim 1, wherein each lid of the plurality of lids is fastened to each of the plurality of compartments using a fastener selected from the group consisting of: a hinge, a flap, and a semi-deformable folded plastic crease.

15. The medication substance organizer of claim 1, wherein each label of the plurality of labels are fastened to each lid of the plurality of lids with a pair of brackets.

16. The medication substance organizer of claim 1, wherein at least one label of the plurality of labels can be fastened to a lid of the plurality of lids corresponding to a compartment of the plurality of compartments, wherein the compartment remains empty and is a placeholder for a medication substance indicated on the at least one label.

17. The medication substance organizer of claim 1, wherein each label of the plurality of labels indicates a specific time and not a segment of time.

18. The medication substance organizer of claim 17, wherein the specific time is chosen by a user of the medication substance organizer.

19. The medication substance organizer of claim 1, wherein the medication substance organizer is made of a food-grade material.

20. The medication substance organizer of claim 1, wherein:

the first visual sign is a green color on a first half of the indicator and the second visual sign is a red color on a second half of the indicator, each slider of the plurality of sliders is held over each indicator of the plurality of indicators by a pair of brackets, the plurality of compartments comprise a plurality of recessed areas in the housing, where each recessed area is adapted to receive one type of medication substance, the plurality of compartments are arranged in a grid layout, each lid of the plurality of lids is fastened to each of the plurality of compartments using a fastener selected from the group consisting of: a hinge, a flap, and a semi-deformable folded plastic crease, each label of the plurality of labels are fastened to each lid of the plurality of lids with a pair of brackets, and each label of the plurality of labels represents a specific time chosen by a user of the medication substance organizer.

* * * * *